US005957076A

United States Patent [19]

Pollack et al.

[11] Patent Number: 5,957,076

[45] Date of Patent: Sep. 28, 1999

[54] OFFSHORE TURRET UPPER BEARING

[75] Inventors: Jack Pollack, Camarillo; Peter Lunde, Westlake Village, both of Calif.; Rene Perratone, Menton, France

[73] Assignee: Imodco, Inc., Calabas Hill, Calif.

[21] Appl. No.: 08/911,924

[22] Filed: Aug. 15, 1997

[51] Int. Cl.[6] ..... B63B 21/50

[52] U.S. Cl. ..... 114/230.12

[58] Field of Search ..... 114/230, 230.1, 114/230.12

[56] References Cited

U.S. PATENT DOCUMENTS

| | | | |
|---|---|---|---|
| 4,601,252 | 7/1986 | Wuttudal | 441/3 |
| 4,753,553 | 6/1988 | Carlsen et al. | 114/230 |
| 5,515,804 | 5/1996 | Pollack | 114/230 |

*Primary Examiner*—Sherman Basinger

*Attorney, Agent, or Firm*—Freich Hornbaker Rosen

[57] ABSTRACT

An offshore system is described, of the type that includes a turret (20) anchored to the sea floor and connected by at least an upper bearing assembly (34) to the vessel hull (14) so the hull can weathervane about the turret, wherein the upper bearing assembly is of moderate cost and high reliability. In one construction, the upper bearing assembly includes upper and lower slider bearing rings (40, 42) that lie facewise adjacent at an interface (44), with the upper bearing ring fixed to the turret and the lower bearing ring supported on the hull through quantities of elastomeric material (102). The elastomeric material permits slight tilt of the turret upper portion without opening a gap at one side of the interface. The lower bearing ring is divided into segments (112A, 112B), and large turret tilt allows pressured lubricant to escape from only one or a few segments that begins to lift up during turret tilt. In another construction, a circle of bearing devices (202) is provided, wherein each device includes a cylinder (224) and piston (226) and a source of pressured fluid that is applied to the device.

15 Claims, 4 Drawing Sheets

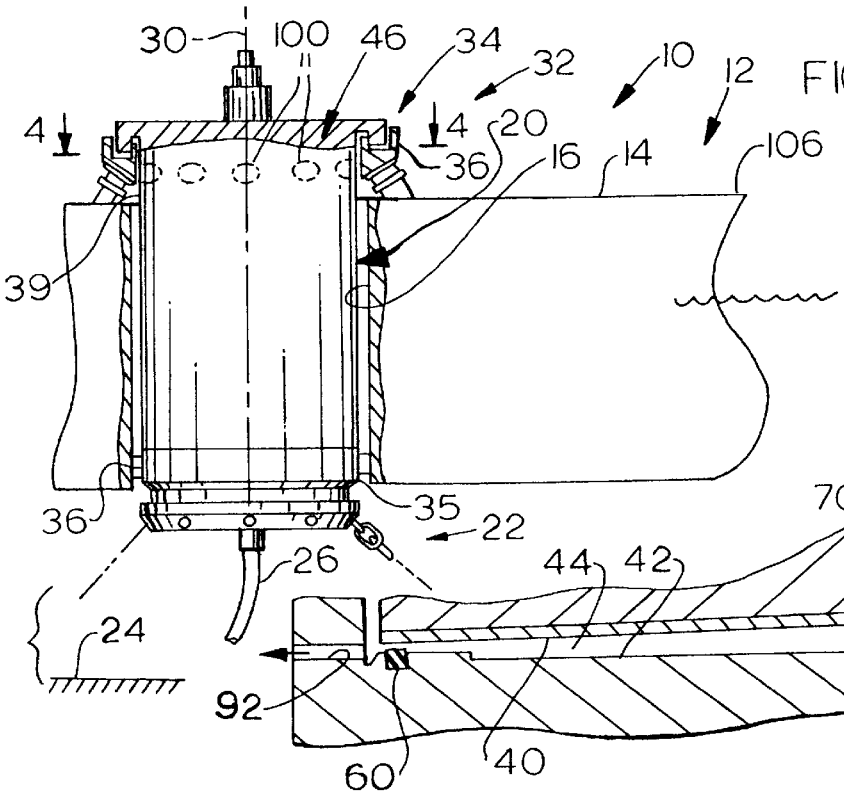
FIG. 1
FIG. 3
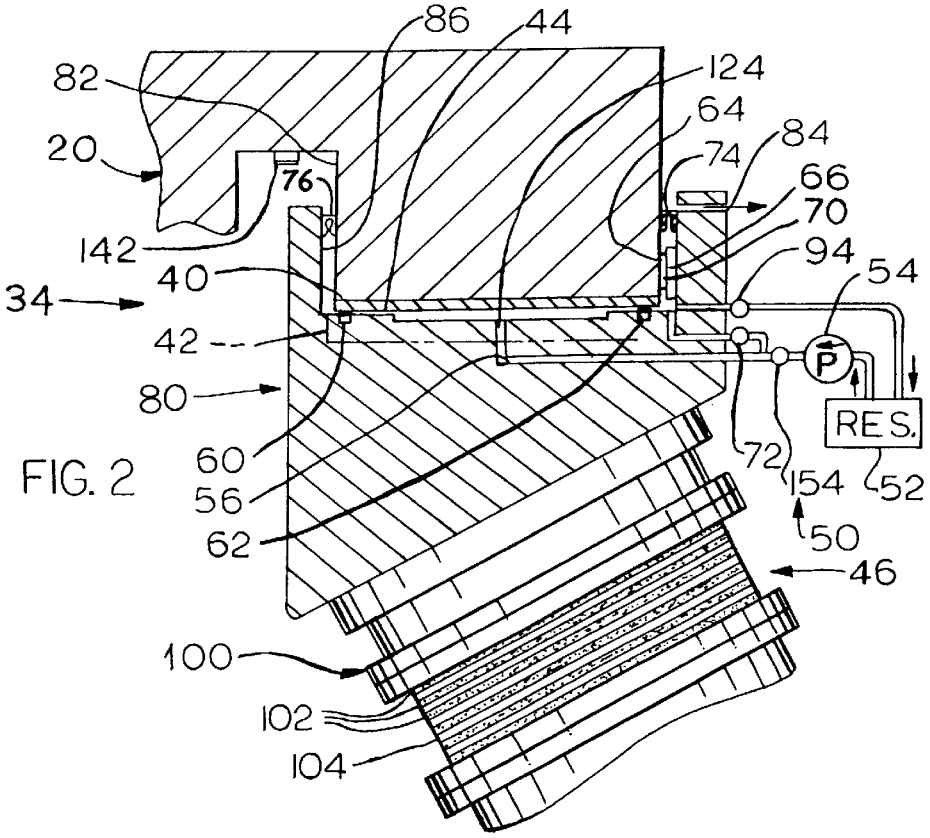
FIG. 2

FIG. 8
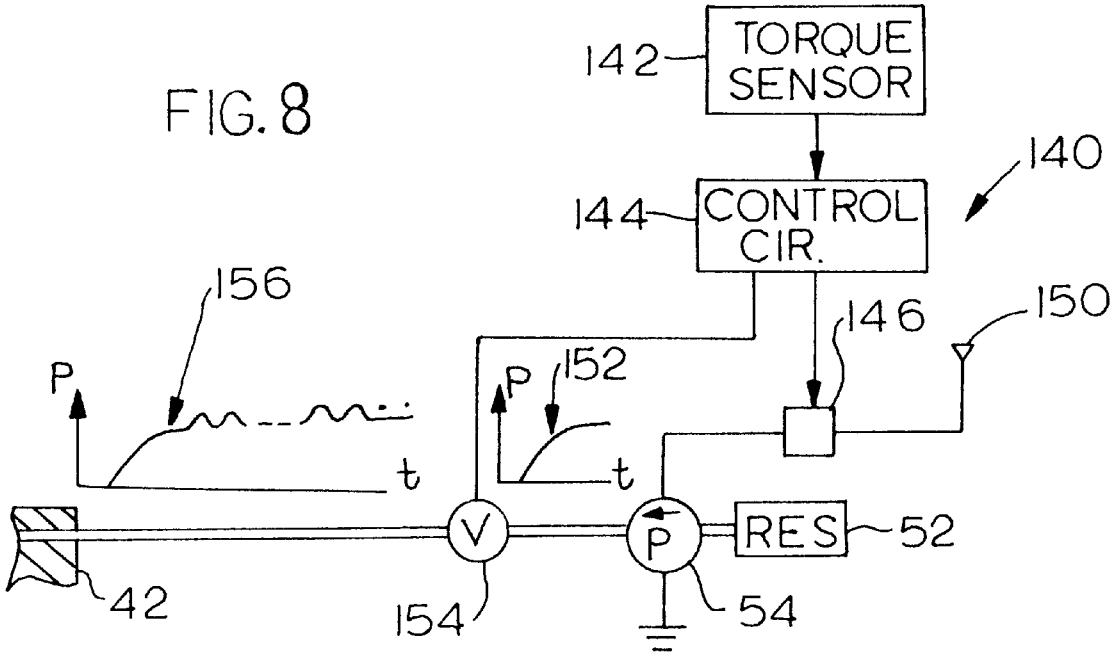
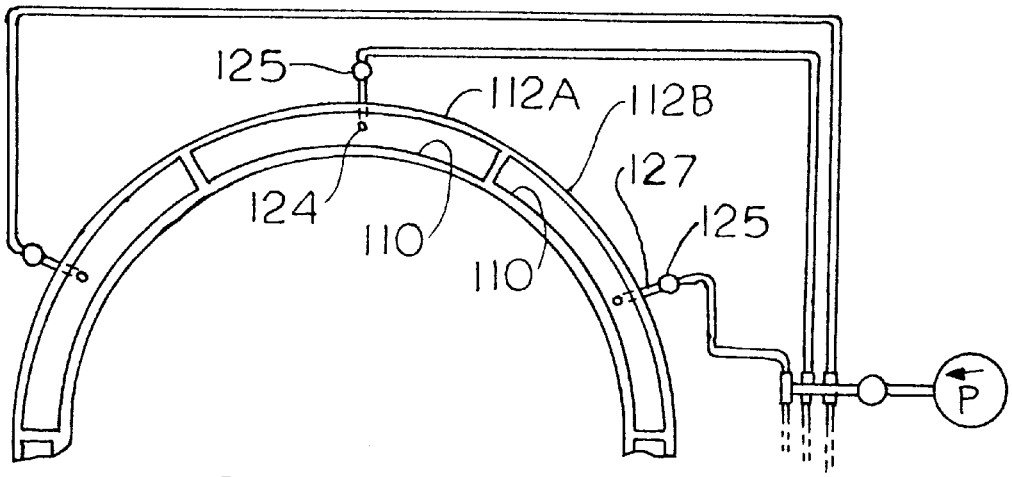
FIG. 9

OFFSHORE TURRET UPPER BEARING

BACKGROUND OF THE INVENTION

One type of offshore system includes a turret that lies in a moonpool of a vessel hull, or outboard of the hull, and a bearing structure that allows the vessel to weathervane (rotate without limit about a vertical axis) around the turret. The turret is anchored to the seafloor and fluid lines usually extend from wells or pipelines at the seafloor up to the turret. The bearing structure includes an upper bearing assembly and sometimes a lower bearing assembly. The upper bearing assembly supports the weight of the turret and the weight of the mooring structure and hoses attached thereto, which may amount to thousands of tons.

The upper bearing assembly has previously been a roller bearing, which has low friction so the turret will turn only a few degrees before the rollers roll. However, there are serious disadvantages in the use of roller bearings. One disadvantage is that reliable roller bearings require raceways that are forged before machining, to provide strength to resist the concentrated forces of individual rollers. Presently, there is no forging equipment available in the world that can forge raceways of greater than eight meters diameter. Some large turrets have diameters of up to twenty meters. Although the raceways can be formed of forged segments that are welded together, this results in reduced strength and in irregularities in the raceway surfaces under load. In addition, the cost for large roller bearings is very high. An upper bearing structure for supporting the weight of a turret on a vessel hull, which avoided the above disadvantages, especially for large turrets of over eight meters diameter, would be of value.

SUMMARY OF THE INVENTION

In accordance with one embodiment of the present invention, an upper bearing assembly is provided for supporting a turret on a vessel hull, which can be constructed in diameters of more than eight meters, and which can be constructed at lower cost than roller bearings. The upper bearing assembly includes upper and lower slider bearing rings that lie facewise adjacent at an interface, with the upper bearing ring connected to the turret. A source of pressured lubricant is coupled to the interface, so that most of the load at the interface is taken by the pressure lubricant. A support structure which supports the lower bearing ring on the hull, includes quantities of elastomeric material spaced about the axis, which permit slight tilt of the lower bearing ring when the upper part of the turret tilts.

One of the bearing rings, such as the lower one, can have a plurality of fluid seals that divide it into segments that are circumferentially spaced. The source of pressured lubricant has a plurality of outlets that supply pressured lubricant to each segment separately. Accordingly, if the turret undergoes large tilt, which causes one side of the upper bearing ring to lift off the corresponding side of the lower bearing ring, the pressure of the fluid will be retained in the rest of the segments that have not significantly been lifted up.

In accordance with another embodiment of the invention, a plurality of bearing devices is provided, that may be arranged in a circle, to support the turret on the hull. Each bearing device includes a cylinder and piston, one lying against a turret bearing surface and the other lying against a vessel hull bearing surface. A source of pressured fluid is coupled to each device, with the force of the piston against a bearing surface taken primarily by the pressured fluid.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial sectional view of an offshore system constructed in accordance with the present invention.

FIG. 2 is a sectional view of a portion of the upper bearing assembly of the system of FIG. 1.

FIG. 3 is a view of a portion of the upper bearing assembly of FIG. 2, shown in a situation where there is sufficient tilt of the turret that one side of the upper bearing ring has lifted considerably off the lower bearing ring.

FIG. 8 is a schematic diagram of the fluid control apparatus of the upper bearing assembly of FIG. 2.

FIG. 9 is a partial plan view of the lower bearing of FIG. 4 and of the source of pressured lubricant.

DESCRIPTION OF THE PREFERRED EMBODIMENTS

Figure 4:
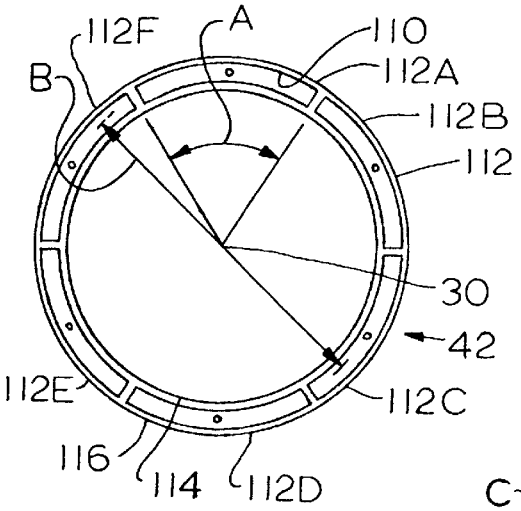
FIG. 4 is a view taken on line 4—4 of FIG. 1, showing the lower bearing ring.

FIG. 1 illustrates an offshore system 10 which includes a vessel 12 having a hull 14 with a vertical opening or moonpool 16 that receives a turret 20. A mooring structure 22 extends from the turret to the seafloor 24, and limits drift of the vessel. The mooring structure illustrated, includes several long and heavy chains that extend in catenary curves to the seafloor and along it, although vertical risers and other mooring structures are available. A fluid conduit 26 extends from a seafloor well or seafloor pipeline up to the turret. The hull 14 can weathervane, that is, rotate without limit about a vertical axis 30 with changing winds and currents. However, the turret 20 is largely non-rotatable, in that it cannot rotate without limit, and usually does not rotate more than perhaps 10°.

A bearing structure 32 that rotatably connects the turret to the hull, includes upper and lower bearing assemblies 34,.36. The upper bearing assembly 34 usually supports most or all of the vertical weight of the turret and loads thereon. Where the turret has a large height, as is shown in FIG. 1, so a lower portion 35 of the turret lies near the hull bottom, a lower bearing assembly 36 is provided and usually takes most of the radial load, that is, the horizontal component of the load from one of the chains when the vessel drifts in a direction to increase tension in that chain. However, it is usually necessary to provide some radial bearing capability at the upper bearing assembly 34. In severe weather, the turret and/or hull may deform, which may cause tilt of the upper portion 39 of the turret. In roller bearing assemblies, tilt has been avoided by providing upper and lower sets of rollers, although this further adds to the cost of roller bearings.

As shown in FIG. 2, and in accordance with one embodiment of the invention, applicant forms the upper bearing assembly 34 so it includes upper and lower slider bearing rings 40, 42 that lie facewise adjacent to one another at an interface 44. The upper bearing ring 40 is connected to the turret, while the lower bearing ring 42 is shown as being part of a lower ring structure 80 that is connected through a support structure 46 to the vessel hull. A source 50 of pressured lubricant such as oil, a water-based lubricant or even water, or other liquid, is coupled to the interface 44 to apply pressured fluid lubricant thereto. The source shown includes a reservoir 52 and a pump 54 that pumps fluid under high pressure from the reservoir 52 through a passageway 56 that leads to the interface 44. A pair of seals 60, 62 prevent the leakage of lubricant out of the region of the interface, unless there is severe tilt of the turret. Radial inner and outer bearing parts 64, 66 form a radial interface region 70, to provide radial bearing capability at the upper bearing assembly. Low pressure seals 74, 76 avoid the escape of lubricant if the vessel rolls or pitches.

The lower ring structure 80 forms a ring-shaped channel 86 with an open top which receives the upper bearing portion 82 which is fixed to the turret There is minimal oil leakage, despite the pressured lubricant applied to the interface 44, because of this construction and the seals, and because of return passages such as 84 that return any leaked oil to the reservoir 52. Applicant prefers not to have a holdown bearing that would prevent turret tilt and corresponding lift up of one side of the upper bearing part 82, as it would require strengthening of the turret and hull at an increased cost.

FIG. 3 shows a situation where the turret has tilted so that one side of the upper slider bearing ring 40 has lifted off the interface 44 and off the lower slider bearing ring 42. As a result of such liftoff, the seals 60, 62 do not contain the pressured lubricant in the interface. Applicant does not attempt to contain such pressured lubricant, but allows it to escape through escape passages 90, 92, which are connected through valves 94 to the lubricant reservoir. The valves 94 allow drainage of fluid only when pressure exceeds a predetermined level, which is higher than that maintained at the radial interface region 70. For example, if the pressure at the interface 44 is normally maintained at 107 kPa (15 psi), and the pressure at the radial interface 64 is maintained at 10 kPa (1.5 psi), then the valves 94 may open when a pressure of more than 20 kPa (3 psi) is reached. The sudden decrease in pressure of fluid at the interface 44, as a result of the tilt, results in the remaining moderately pressured fluid applying only a small upward force to the uplifted side of the upper bearing ring 40. Measures described below, are taken to assure that the opposite side of the interface continues to be supported by pressured fluid.

The sudden reduction in fluid pressure at the interface 44 caused by tilt, occurs when there is only small tilt. Applicant has designed a construction that requires a greater amount of tilt before there is a sudden release of lubricant pressure at one side, by appropriate selection of the support structure 46 that supports the lower bearing portion 80 on the vessel hull. The support structure 46 includes a plurality of supports 100 that each includes a quantity of elastomeric material 102. The elastomeric material 102 is in the form of plates of elastomeric material separated by steel plates 104. The elastomeric material 102 is in compression, but the amount of compression varies with the load applied to it. When the turret tilts, so the load on one side of the lower bearing portion 80 is suddenly greatly reduced, the previously compressed elastomeric material 102 expands, and thereby keeps the upper and lower bearing rings close together. As shown in FIG. 1, the support structure 46 includes a plurality of supports 100, with the figure showing a system that includes twelve of such supports, which are circumferentially spaced about the axis 30. Thus, the use of elastomeric material in the support structure for the upper bearing assembly, enables moderate tilt of the upper slider bearing ring with respect to the lower one, without liftoff of one side. However, if liftoff occurs, there is a sudden decrease in lubricant pressure at the side of the upper bearing ring which lifts off the lower bearing ring, to decrease the amount of tilt.

Figure 5:
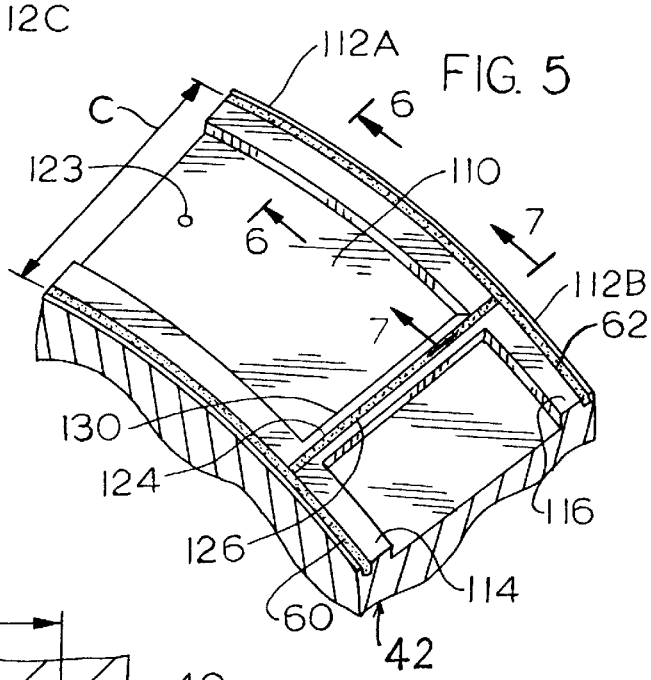
FIG. 5 is a partial isometric view of the lower bearing ring of FIG. 4.
Figure 6:
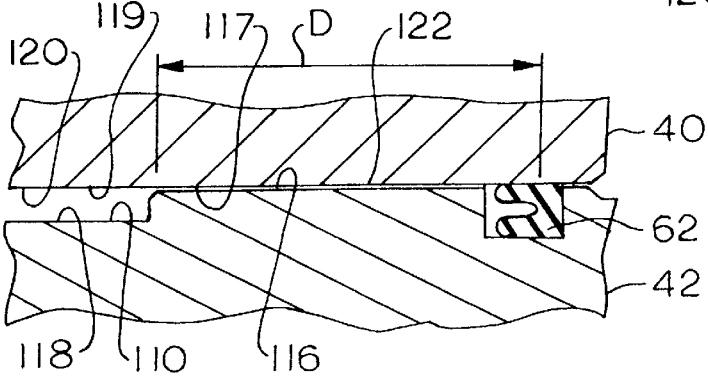
FIG. 6 is a view taken on line 6—6 of FIG. 5, and also showing a portion of the upper bearing ring.

FIGS. 4 and 5 illustrate the construction of the lower slider bearing ring 42. The bearing ring has recesses 110 which form segments 112 that are circumferentially spaced about the turret axis 30. The particular ring shown has six of such segments 12A–12E which each subtend an angle A of 60°. The recesses leave radially inner and outer slide surfaces or regions 114, 116 and recesses between them. The seals 60, 62 (FIG. 5) lie in grooves of the inner and outer slide surfaces, respectively. FIG. 6 shows that the lower surface 120 of the upper bearing ring 40, lies adjacent to the radially outer slide surface 116, with a film 122 of lubricant between them. FIG. 5 shows that an outlet 123 is connected to each recess to apply pressured oil to the entire recess. The recess 110 distributes the pressured lubricant. So long as the pressure of the lubricant is maintained, the entire width of the interface, between the high pressure seals 60, 62 provides upward force to the upper bearing ring. FIG. 9 shows that shutoff valves 125 are connected in series with each flow line 127 that carries fluid to a recess. Each valve 125 shuts off flow if the pressure on the downstream side of the valve drops, such as to 7 kPa (1 psi) below the pressure on the upstream side.

The inner and outer slide surfaces 114, 116 are provided to support the upper ring on the lower one, in the event that lubricant pressure is lost. The presence of the recesses makes it necessary to precisely finish (e.g. by grinding and/or polishing) only reduced surface areas of the upper and lower bearings, these being the inner and outer slide surfaces 114, 116, and corresponding areas 117 of the upper bearing ring. If lubricant pressure is lost, wear will be concentrated on the inner and outer slide surfaces, but this is expected to occur only once in a while. The surface regions 118, 119 of the bearing ring can be left unfinished, which reduces cost. Each of the bearing rings 40, 42 can be constructed of welded-together or cast parts, because they do not have to withstand large concentrated forces such as of a roller.

Figure 7:
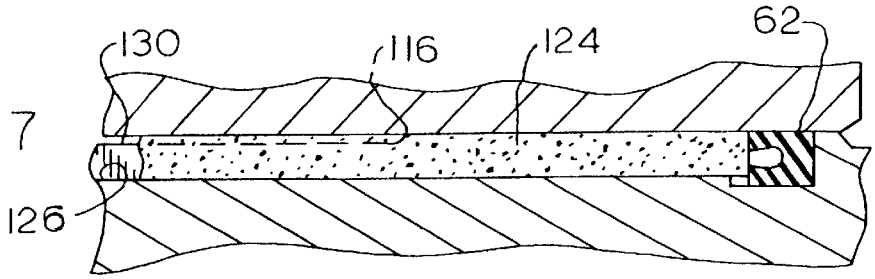
FIG. 7 is a view taken on line 7—7 of FIG. 5, and also showing a portion of the upper bearing ring.

Applicant seals the segments such as 112A, 112B (FIG. 5) from each other by segment seals 124. Each segment seal lies in a radial groove 126 formed in a spoke area 130 of the lower bearing ring 42. As shown in FIG. 7, the spoke area 130 is preferably slightly recessed from the inner and outer slide surfaces 114, 116, so the spoke areas 130 do not have to be precisely finished. The segment seals 124 may not seal as well as the inner and outer slide surface seals 60, 62. However, a slight leakage passed a segment seal 124 is not harmful, since it only allows a very low flow of pressured lubricant into an adjacent segment where the pressure has suddenly been reduced due to turret tilt.

Figure 5A:
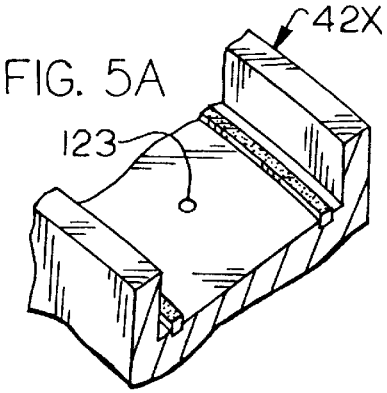
FIG. 5A is a partial isometric view of an alternate bearing ring that can be used instead of the one shown in FIG. 5.

Instead of using segments sealed from each other, it is possible to use a continuous lower slider bearing ring. FIG. 5A shows part of such continuous lower bearing ring at 42X. The presence of the elastomeric material (162 in FIG. 2) in the support structure 42 that supports the lower slider bearing ring on the hull, will avoid loss of lubricant pressure in the event of all but very large tilt forces.

FIG. 8 illustrates fluid control apparatus 140 which controls the pressure of fluid at the interface between the upper and lower slider bearing rings 40, 42. A vessel typically remains headed in a predetermined direction, with minimal rotation of no more than a few degrees in either direction, for long periods of time (a plurality of hours). In order to minimize wear on the pumps and avoid leakage when high pressure lubricant is not required, applicant stops supplying pressurized lubricant when the hull is not rotating. FIG. 2 shows a sensor 142, which senses torque transmitted by the turret to the upper slider bearing ring 40. As shown in FIG. 8, the torque sensor 142 delivers an output to a control circuit 144, as where the torque sensor is a resistor whose resistance varies with sensed torque. When little or no torque is detected, the control circuit opens a switch 146 to prevent electricity or hydraulic or pneumatic fluid from a source 150 from flowing through the pump 54 to energize it. When the torque sensor senses a torque that exceeds a predetermined level, the control circuit 144 closes the switch 146 to begin energization of the pump 54 so it pumps lubricant from the reservoir 52 toward the lower bearing ring 42.

In one example, the vessel hull has turned 5° about the vertical axis of the turret, and the turret has also turned with the hull, resulting in increased tension on the catenary chains shown in FIG. 1, which tend to turn the turret back towards its initial position. When this level of torque is sensed, the control circuit allows the pump to be energized. The lubricant pressure increases as shown by graph 152. The control circuit controls a valve 154 which can constrict the path along which lubricant flows, to vary the pressure. As shown by graph 156, the valve 154 is operated so that when full operating lubricant pressure is reached, the valve modulates the lubricant pressure, as by increasing and decreasing it by five percent every two seconds, during a period of one minute. Such modulation of lubricant pressure helps to overcome static friction at the interface of the upper and lower bearing rings, to facilitate the start of turret rotation back towards its quiescent position (wherein the chains are not twisted). Thereafter, the lubricant pressure can remain steady or can change, for example, in response to the vertical load on the turret.

When the vessel weathervanes, it turns at a very low rotation rate, such as one revolution per ten minutes, and almost always turns at a rate of less than one revolution per minute. For a bearing ring of twenty meters diameter and a rotation rate of one revolution per minute, the surface of the bearing ring moves at one meter per second, or 2 miles per hour. As a result, the speed of rotation of the upper bearing ring has little effect on bearing performance. Also, since rotation is not rapid and continuous in one direction, friction losses are not important, but only the ability to enable rotation with only moderate torque.

Applicant prefers to control the lubricant pressure so considerable weight, such as 10% of the total, is supported by the inner and outer slide surfaces 114, 116 (FIG. 5). In one example, the average diameter (B in FIG. 4) of the bearing rings is twenty meters, the width C of each bearing ring is 1.5 meters, and the width D (FIG. 6) of the outer slide surface 116 and of the inner slide surface, are each twenty centimeters. The downward load to be supported by the upper and lower bearing rings is two thousand metric tons. A lubricant pressure of about 15 psi or 107 kPa could result in the entire weight being supported on the pressured lubricant, although 96 kPa could be used to apply about 10% to the inner and outer slide surfaces. The lubricant pressure can be adjusted in accordance with the load, by using a load sensor positioned at about the same location as the sensor 142 of FIG. 2.

Figure 10:
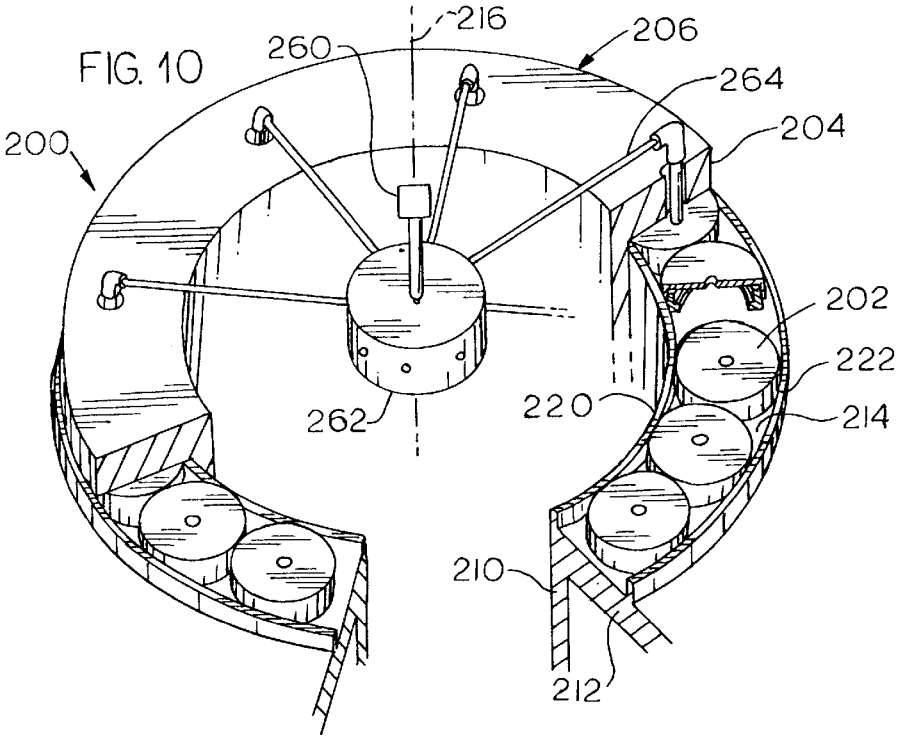
FIG. 10 is a partial isometric view of an upper bearing assembly of another embodiment of the invention.

FIG. 10 illustrates another upper bearing assembly 200 which includes a group of bearing devices 202. The bearing devices support an upper bearing part 204 of the turret 206 on a lower bearing part 210 of the vessel hull 212. The devices 202 are confined to a circular track 214 that is concentric with the turret axis of rotation 216. The track is formed by inner and outer track walls 220, 222 of the hull.

Figure 11:
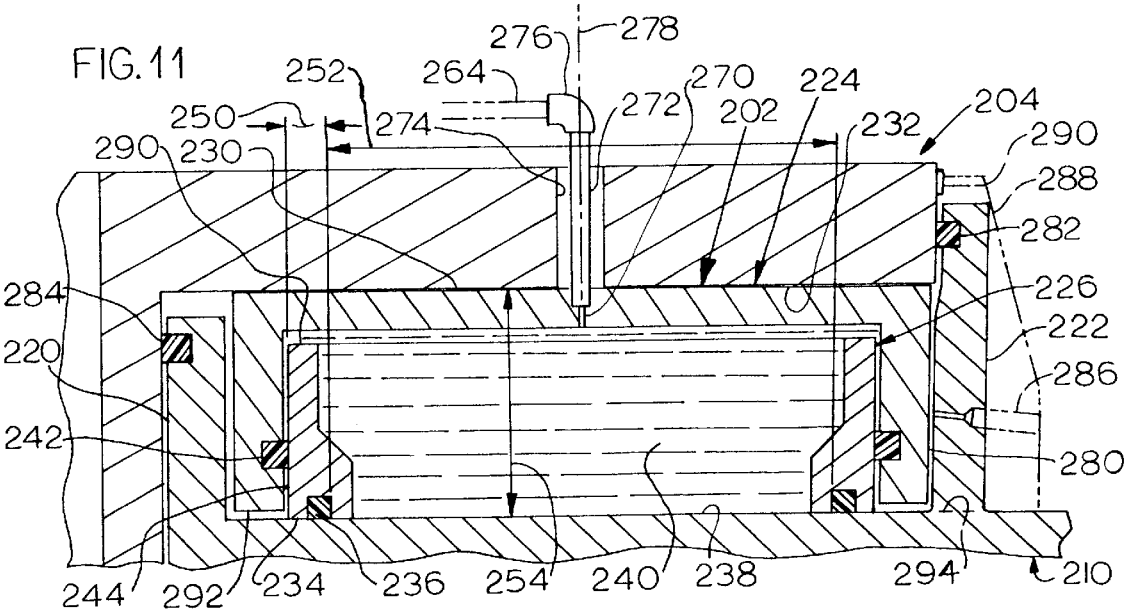
FIG. 11 is a sectional view of one of the bearing devices of the assembly of FIG. 10.

FIG. 11 shows that each bearing device 202 includes upper and lower elements 224, 226. The upper element has an upper face 230 that bears against an upper bearing surface 232 of the turret bearing part. The lower element lies within the upper one. The lower element has a lower face 234 that bears (at least at its seal 236) against a lower bearing surface 238 of the hull lower bearing part. A pressured fluid (e.g. 100 psi) 240 such as oil lies within the device 202 and pushes the elements apart.

A medium pressure face seal 236 seals the lower face 234 of the lower element to the lower bearing surface 238. A medium-pressure radial seal 242 seals the gap 244 between the outside of the lower element and the inside of upper one. This results in the pressured fluid 240 being trapped between the elements and pushing the upper element up while pushing the lower element down. The downward force on the lower element is equal to the pressure of the fluid times the area within the ring-shaped region 250. The pressured fluid pushes directly against the lower bearing surface 238 over a circle of diameter 252. It can be seen from FIG. 11 that the diameter (252 plus 2×250) of the bearing device is greater than its height 254.

The elements 224, 226 act like a cylinder (not necessarily of cylindrical shape) and piston, so the upper element can move up or down by a moderate amount such as up to two centimeters. The gap 244 is large enough that the upper element can tilt by up to a few degrees (e.g. 5 degrees). As a result, if the turret and/or hull deform in severe weather so the distance 254 between bearing surfaces 232, 238 changes by a small amount or they tilt away from parallelism, the bearing devices can still support the turret on the hull. Such a warp would commonly result in the distance 254 for bearing devices at one side of the turret axis increasing while the distance for bearing devices on the opposite side decreasing. In one example, the outer diameter of each bearing device is one meter.

FIG. 10 shows a source 260 of pressured fluid connected through a manifold 262 to fluid conduits 264 that each extends to one of the bearing devices 202. Only every other bearing device receives pressured oil and supports the turret with the others useful as spares. FIG. 11 shows a hole 270 in the upper element and a pipe 272 of the conduit that is coupled to the hole 270 and that extends through a hole 274 in the turret part 204. The upper end of the pipe is connected through a swivel joint 276 to a pipe that extends from the manifold. The bearing device 202 moves with the turret as the turret rotates, although the bearing device can rotate about its own axis 278.

When the turret turns (e.g. by 10's of degrees) the outer walls 280 of the upper, or outer element 224 slide along the inner and outer track walls 220, 222, or rotate on one track wall and slide on the other. Lubricating oil at near zero pressure is maintained therein to minimize friction. Low pressure seals 282, 284 avoid spillage if the vessel tilts, and a gravity pipe 286 can return excess oil to a reservoir. FIG. 11 shows, in phantom lines, an extension 288 of the outer wall carrying a radial bearing 290 that keeps the upper end of the turret centered on its axis.

The pressure of oil can be set to be slightly less than that required to keep the upper element 224 above the top surface 290 of the lower element, and/or to keep the lower element lower surface 292 above the lower bearing surface 238. As a result, the upper element presses with a low force against the surface 290. The advantage of this is that small variations in the load on the turret or fluid pressure do not cause the turret to rise or fall. The pressure is preferably regulated so when there is more than a slight increase in turret weight (as when mooring chains are lifted off the sea floor), the fluid pressure is increased. The pressure can be closely regulated to maintain the conditions of FIG. 11. A door 294 is provided to enable replacement of a damaged bearing device, although spares are already present.

Thus, the invention provides an upper bearing assembly for supporting a turret on a vessel hull, which can be constructed to be reliable in very large sizes, and at moderate cost. In one assembly, the upper bearing assembly includes upper and lower slider bearing rings lying adjacent at an interface, with pressured lubricant at the interface preferably supporting most of the weight. The lower bearing ring can be supported by quantities of elastomeric material spaced about the turret axis. One of the bearing rings such as the lower one, can be divided into circumferentially-spaced sectors to avoid loss of pressure in all sectors. In another assembly, a plurality of bearing devices forming pistons and cylinders can be confined to a track and biased apart by pressured fluid, so the bearing devices support the turret on the vessel hull. The upper bearing structure is useful for vessels used in a variety applications, including the production of hydrocarbons from undersea wells, and for drilling vessels that drill such wells.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore system which includes a vessel hull structure that floats in a sea and that can weathervane and that forms a vertical opening, a turret structure that lies in said opening, a mooring apparatus that extends from said turret structure to the seafloor, and a bearing apparatus that rotatably supports said turret structure on said vessel structure and that includes an upper bearing assembly, wherein:

said upper bearing assembly includes upper and lower bearing parts that have ring-shaped bearing surfaces that substantially face each other, with the upper bearing part connected to said turret structure and the lower bearing part connected to said hull structure, and with at least one of said structures forming largely vertical inner and outer track walls at the inside and outside of said ring-shaped bearing surfaces;

a plurality of individual bearing devices that lie between said upper and lower bearing surfaces and between said inner and outer track walls, with each device having upper and lower elements lying respectively against said upper and lower bearing surfaces, with a first of said elements forming a cylinder with a face that presses against a first of said bearing surfaces and with a second of said elements forming a piston that is moveable vertically within said cylinder and that has a face seal that lies against a second of said bearing surfaces, with one of said elements having a radial seal that seals said piston to said cylinder as said piston moves up and down;

each of said pistons has an area within said face seal which is more than half the area of the piston as seen in a plan view; and including means for supplying pressured fluid to said area within said face seal.

2. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower bearings that lie facewise adjacent at an interface, with the upper bearing connected to said turret and the lower bearing supported on said hull; and including a source of pressured lubricant coupled to said interface;

a sensor that senses when said hull is rotating and when said hull is not rotating, relative to said turret:

said sensor being connected to said source to control said source to apply pressured lubricant to said interface when said hull is rotating relative to the seafloor and to not apply pressured lubricant to said interface when said hull is not rotating.

3. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower bearings that lie facewise adjacent at an interface, with the upper bearing connected to said turret and the lower bearing supported on said hull; and including a source of pressured lubricant coupled to said interface;

a sensor which senses when said lower bearing is about to turn relative to said upper bearing after not turning, and which is connected to said source, and which controls said source to time modulate the pressure of said fluid applied to said interface, when said upper bearing is about to turn.

4. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower slider bearing rings that lie facewise adjacent at an interface, with the upper bearing ring connected to said turret and the lower bearing ring supported on said hull; and including a source of pressured lubricant coupled to said interface;

said system is devoid of a holdown bearing device that would prevent lift off of one side of said upper slider bearing ring relative to said lower bearing ring when an upper portion of said turret tilts;

said upper bearing assembly includes means for enabling the escape of pressured lubricant primarily only from a side of said interface when said upper slider bearing ring lifts up off said lower slider bearing ring during tilt of said turret.

5. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel wherein:

said bearing structure includes upper and lower bearing parts that have bearing surfaces that substantially face each other, with the upper bearing part connected to said turret and the lower bearing part connected to said hull;

a plurality of individual devices that lie between said upper and lower bearing surfaces, with each device having upper and lower elements lying respectively against said upper and lower bearing surfaces, and with said upper and lower elements being biased apart but being largely vertically moveable relative to each other;

said lower bearing part having largely vertical walls (220, 222) forming a circular track (214) between them, with said individual devices lying between said tracks, and including a lubricating fluid (240) on said track between said largely vertical walls.

6. The system described in claim 5 wherein:

said lower elements are open to said circular track, with said lubricating fluid forming a film of fluid on which said lower elements move on said bearing surface and with said lubricating fluid also lying between said elements to serve as hydraulic fluid to push up said upper elements.

7. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel, wherein:

said bearing structure includes upper and lower bearing parts that have bearing surfaces that substantially face each other, with the upper bearing part connected to said turret and the lower bearing part connected to said hull;

a plurality of individual devices that lie between said upper and lower bearing surfaces, with each device having upper and lower elements lying respectively against said upper and lower bearing surfaces, and with said upper and lower elements being biased apart but being largely vertically moveable relative to each other;

a quantity of lubricating fluid lying between said upper and lower elements and biasing them apart, said quantity of lubricating fluid also lying between said lower elements and said lower bearing surface to facilitate sliding of said lower elements on said lower bearing surface.

8. The system described in claim 7 wherein:

said lower bearing part has a pair of upstanding walls that form a circular track, with said individual devices being closely confined to movement along said track.

9. The system described in claim 8 including:

means for removing portions of said quantity of lubricating fluid from at least one location that lies between said upstanding walls but outside said individual elements.

10. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower bearing parts that have bearing surfaces that substantially face each other, with the upper bearing part connected to said turret and the lower bearing part connected to said hull;

a plurality of individual devices that lie between said upper and lower bearing surfaces, with each device having upper and lower elements lying respectively against said upper and lower bearing surfaces, with said upper elements being moveable with respect to said upper bearing surface and said lower elements being moveable with respect to said lower bearing surface, and with said upper and lower elements being biased apart but being largely vertically moveable relative to each other;

at least one of said bearing parts has concentric inner and outer track walls that form a circular track between them and that confine said devices to relative movement along said track;

said devices have circular peripheries that lie between said track walls.

11. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower slider bearing rings that lie facewise adjacent at an interface, with the upper bearing ring connected to said turret and with said lower bearing ring coupled to said hull;

a source of pressured lubricant coupled to said interface;

a first of said slider bearing rings has a plurality of fluid seals at said interface that divide said first slider bearing ring into a plurality of segments that are circumferentially space about said axis, and said source of pressured lubricant has a plurality of outlets that each supplies pressured lubricant, with at least one outlet opening to each of said segments;

a plurality of support structures that are circumferentially spaced about said axis and that each supports a location along said lower slider bearing ring on said hull, each support structure comprising a quantity of elastomeric material with said quantities of elastomeric material supporting the weight of said turret and loads thereon.

12. An offshore system which includes a vessel hull that floats in a sea and that can weathervane and that forms a vertical opening, a turret that lies in said opening, a mooring structure that extends from said turret on said vessel and that includes an upper bearing assembly, wherein:

said upper bearing assembly includes upper and lower slider bearing rings that lie facewise adjacent at an interface, with the upper bearing ring connected to said turret and with said lower bearing ring coupled to said hull;

a source of pressured lubricant coupled to said interface;

a first of said slider bearing rings has a plurality of fluid seals at said interface that divide said first slider bearing ring into a plurality of segments that are circumferentially spaced about said axis, and said source of pressured lubricant has a plurality of outlets that each supplies pressured lubricant, with at least one outlet opening to each of said segments;

said interface has radially inner and outer regions, and including inner and outer seals that respectively seal said inner and outer regions of said interface, with said outer seals being constructed to rapidly leak pressured lubricant from an interface outer location that exceeds a predetermined thickness, whereby to oppose tilt of said turret.

13. An offshore system which includes a vessel hull that floats in a sea and that can weathervane and that forms a vertical opening, a turret that lies in said opening, a mooring structure that extends from said turret to the seafloor, and a bearing structure that rotatably supports said turret on said vessel and that includes an upper bearing assembly, wherein:

said upper bearing assembly includes upper and lower bearing parts that have bearing surfaces that substantially face each other, with the upper bearing part connected to said turret and the lower bearing part connected to said hull;

a plurality of individual devices that lie between said upper and lower bearing surfaces, with each device having upper and lower elements lying respectively against said upper and lower bearing surfaces, and with said upper and lower elements being biased apart but being vertically moveable relative to each other;

said bearing parts forming concentric inner and outer track walls that form at least one circular track with said devices being confined to movement along said track.

14. The system described in claim 13 wherein:

said upper and lower elements form cylinder and piston elements with a pressured fluid space between them and with pressured fluid lying in said space and pushing said elements vertically apart, with one of said elements having an opening that opens to said at least one track, with said pressured fluid space coupled to said opening to apply said pressured fluid to said track.

15. The system described in claim 13 wherein:

each of said devices has a circular periphery that is confined between said inner and outer track walls.

* * * * *